US006007218A

United States Patent [19]

German et al.

[11] Patent Number: 6,007,218

[45] Date of Patent: Dec. 28, 1999

[54] SELF-CONTAINED LASER ILLUMINATOR MODULE

[75] Inventors: John D. German, Cedar Crest; Eric J. Cramer; Michael D. Tocci, both of Albuquerque; Brian K. Spielbusch, Edgewood; Steven J. Saggese, Albuquerque, all of N. Mex.

[73] Assignee: Science & Engineering Associates, Inc., Alburquerquen, N. Mex.

[21] Appl. No.: 08/967,426

[22] Filed: Nov. 10, 1997

Related U.S. Application Data

[63] Continuation-in-part of application No. 08/518,230, Aug. 23, 1995, Pat. No. 5,685,636.

[51] Int. Cl.[6] ..... F21K 7/00; F21V 8/00

[52] U.S. Cl. ..... 362/259; 362/187; 362/268; 362/553; 385/93

[58] Field of Search ..... 362/32, 102, 187, 362/259, 294, 551, 553, 555, 268, 277; 42/100, 103; 385/88, 92, 93

[56] References Cited

U.S. PATENT DOCUMENTS

| | | | |
|---|---|---|---|
| Re. 33,572 | 4/1991 | Meyers | 250/504 R |
| 4,399,541 | 8/1983 | Kovats et al. | 372/36 |
| 4,734,550 | 3/1988 | Imamura et al. | 219/121.61 |
| 4,834,491 | 5/1989 | Aoki et al. | 385/94 |
| 4,842,277 | 6/1989 | LaCroix | 273/84 ES |
| 4,843,336 | 6/1989 | Kuo | 340/521 |
| 4,933,816 | 6/1990 | Hug et al. | 362/551 |
| 4,934,086 | 6/1990 | Houde-Walter | 42/103 |
| 4,991,183 | 2/1991 | Meyers | 372/100 |
| 5,036,517 | 7/1991 | Meyers | 372/29 |
| 5,054,878 | 10/1991 | Gregely et al. | 385/33 |
| 5,072,342 | 12/1991 | Minovitch | 362/111 |
| 5,243,894 | 9/1993 | Minovitch | 89/1.11 |
| 5,343,652 | 9/1994 | Johnson | 43/132.1 |
| 5,351,330 | 9/1994 | Jongewaard | 385/93 |
| 5,364,097 | 11/1994 | Lyon | 463/47.4 |
| 5,392,550 | 2/1995 | Moore et al. | 42/103 |
| 5,596,401 | 1/1997 | Kusuzawa | 356/23 |
| 5,682,236 | 10/1997 | Trolinger et al. | 356/345 |
| 5,808,226 | 9/1998 | Allen et al. | 89/1.11 |

*Primary Examiner*—Alan Cariaso
*Attorney, Agent, or Firm*—Perkins, Smith & Cohen, LLP; Jacob N. Erlich; Jerry Cohen

[57] ABSTRACT

A self-contained laser illuminator module for primary use in a laser security device which is adapted to produce an optimally effective and eye-safe laser beam for use as a laser visual countermeasure. The laser illuminator module includes control electronics having a high-power laser adapted to generate a preselected wavelength and intensity, a fiber optic means in optical communication with the control electronics, and a means for mounting to a security device having a collimating lens. The present invention generates a laser beam to illuminate or create temporary visual impairment of a potential adversary which results in hesitation, delay, distraction, surrender or retreat.

32 Claims, 17 Drawing Sheets

SELF-CONTAINED LASER ILLUMINATOR MODULE

This invention is a continuation-in-part of U.S. patent application Ser. No. 08/518,230, filed Aug. 23, 1995, now U.S. Pat. No. 5,685,636 entitled "Eye Safe Laser Security Device" which is hereby incorporated by reference.

Portions of this invention were also developed with United States Government support under Contract No. F19628-96-C-0085 awarded by the United States Air Force. The Government has certain rights to this invention.

FIELD OF THE INVENTION

This invention relates to non-lethal, non-eye damaging laser security devices, such as those described in the above-referenced patent application, and the use of such devices as non-damaging weapons and security systems to provide warning and/or visual impairment through illumination by bright, visible laser beams. Specifically, such devices require laser light at predetermined wavelengths, beam diameters, intensities, and intensity distributions within the beam and to create temporary visual impairment (by glare and/or flashblinding) to cause hesitation, delay, distraction, and reductions in combat and functional effectiveness when used against humans in military, law enforcement, corrections (prisons) and security applications. To maximize the effectiveness of laser security devices while minimizing the risk of eye injury, the laser beam produced by these devices must be optimized through creative optical, electrical, and mechanical design. Furthermore, it important to make portable versions of laser security devices smaller and lighter so that the users are not hampered in their ability to carry and apply them.

BACKGROUND OF THE INVENTION

In the present domestic and world political climate, U.S. military forces are faced with a growing number of situations in which less-than-lethal response options are essential. Recent examples include Somalia, Cuban refugee camps and Haiti, as well as riots in Los Angeles. In these types of situations, where military, political and humanitarian objectives preclude the use of lethal force except when personnel are in immediate danger, the individual soldier must have less-than-lethal options available to him or her to warn, deter, delay, or incapacitate a wide range of adversaries.

Low-energy lasers can be effective, non-lethal weapons for a variety of military missions as well as civilian law enforcement applications. Through the effect of illumination, glare, flashblinding and psychological impact, lasers can create hesitation, delay, distraction, temporary visual impairment, and reductions in combat and functional effectiveness when used against local inhabitants trying to steal supplies, intruders, military and paramilitary forces, terrorists, snipers, criminals and other adversaries. Furthermore, if continuous-wave or repetitively pulsed lasers having the required intensity are used, these effects can be created at eye-safe exposure levels below the maximum allowed by international safety standards. The low-energy laser systems used to produce these effects are called laser visual countermeasure devices.

As disclosed in the present invention, additional specific applications for which such lasers would enhance effectiveness include security for military and industrial facilities, apprehension of unarmed but violent subjects, protection from suspected snipers, protection from assailants and crowd/mob control. Another important class of applications are those which limit the use of potentially lethal weapons because innocent people are present. These include hostage situations, protection of political figures in crowds, airport security, and prison situations where guards are present. A similar situation occurs when use of firearms or explosives in the battlefield may cause unacceptable collateral damage to friendly personnel, equipment or facilities (including aircraft or electronic equipment). Finally, there are portable applications, such as raids on hostile facilities and hostage rescues, where even a few seconds of distraction and visual impairment can be vital to the success of the mission.

Until recently, the relatively large size of laser-producing components have prevented the use of laser technology in personal protection or security applications.

In recent years, however, compact laser-producing components have made the benefits of laser technology available to numerous applications, such as compact disc players, medical tools and welding appliances.

Lasers are capable of a wide range of effects on human vision which depend primarily on the laser wavelength (measured in nanometers), beam intensity at the eye (measured in watts/square centimeter), and whether the laser is pulsed or continuous-wave. These effects can be divided into three categories: (1) glare; (2) flashblinding; and (3) retinal lesion.

The glare effect is a reduced visibility condition due to a bright source of light in a person's field of view. It is a temporary effect that disappears as soon as the light source is extinguished, turned off or directed away from the subject. If the light source is a laser, it must emit laser light in the visible portion of the wavelength spectrum and must be continuous or rapidly pulsed to maintain the reduced visibility glare effect. The degree of visual impairment due to glare depends on the ambient lighting conditions and the location of the light source relative to where the person is looking. In bright ambient lighting, the eye pupil is constricted, allowing less laser light into the eye to impair vision. Also, if the laser is not near the center of the visual field, it does not interfere as much with an individual's vision.

In contrast, the flashblind effect is a temporary reduction in visual performance resulting from exposure to any intense light, such as those emitting from a photographic flashbulb or a laser. The nature of this impairment makes it difficult for a person to discern objects, especially small, low-contrast objects or objects at a distance. The duration of the visual impairment can range from a few seconds to several minutes, and depends upon the amount of light intensity employed, the ambient lighting conditions and the person's visual objectives. The major difference between the flashblind effect and the glare effect is that visual impairment caused by flashblind remains for a short time after the light source is extinguished, whereas visual impairment due to the glare effect does not.

The effectiveness of a given laser as a security device is directly related to how bright the laser appears to the eye. The apparent brightness of a laser is a function of the laser intensity at the eye and the laser wavelength. The intensity at the eye, measured in watts per square centimeter, can be increased by control of the laser output power level and laser beam size. The wavelength, however, is a function of the type of laser employed and is therefore more severely constrained by the limited laser options available which are suitable for the security device applications of the present invention.

If the intensity of a laser beam at the eye exceeds a certain level, injury to the retina may occur in the form of lesions (i.e., small burns at the focal spot of the laser beam). To ensure that laser security devices are non-damaging to the human eye, the intensity present at the subject's eye must be below the threshold for permanent damage. The definitive laser safety parameter as defined by the American National Standards Institute in ANSI Z136.1-1993 is the Maximum Permissible Exposure (MPE) which is measured in watts per square centimeter for continuous (non-pulsed) laser beams. If the laser intensity anywhere within the beam diameter exceeds the MPE, the possibility of retinal injury exists. The value of the MPE for short (e.g., quarter second) exposures to visible laser light is 2.55 milliwatts per square centimeter.

Prior art in the area of self-contained laser devices focus on low-power lasers (i.e., output laser power of less than 5 milliwatts) such as those used in laser pointers (e.g., Edmund Scientific Stock Number P38,914), surveying equipment, alignment lasers, and laser gun sights. For these devices, the issues that are important for eye-safe laser security devices (i.e., maximum beam intensity, beam intensity profile, and beam uniformity) do not play a significant role in design. Furthermore, with these very low-power lasers, diode cooling and thermal management are not important issues. As such, the present invention resolves six key problems which must be considered in the design of laser illuminator subsystems for eye-safe laser security devices: (1) distribution of laser power within the beam diameter, (2) control of the laser power output, (3) size, (4) mechanical stability, (5) thermal management, and (6) impact of the laser on the adversary.

The first problem examines the laser power. The laser power within a typical laser beam is not evenly distributed throughout the diameter of the beam. This means that the laser power usually concentrates in one or more intensity peaks within the beam. The output beam from a semiconductor laser diode (i.e., laser) is particularly poor in this respect, having a sharply peaked intensity distribution. Laser diode beams also provide design difficulties because they are highly elliptical and exhibit sufficient astigmatism to redistribute the beam intensity as the distance from the laser increases. FIG. 1 shows the intensity profile of such a beam. For eye safety purposes, it is desirable to minimize the number and magnitude of these "hot spots." Also, because the eye perceives apparent brightness based on the average intensity within the beam rather than the peak intensity, the effectiveness of a laser security device is enhanced if the power is distributed as evenly as possible throughout the beam. Preferably, the optimum laser intensity distribution is a smooth curve with minimal peaking at the center of the beam and little astigmatism, such as shown in FIG. 2. As such, the maximum value of the laser intensity is just below the MPE value given above.

The second design problem, also related to effectiveness of the laser and eye safety, is control of the maximum power output of the laser over time. If the laser output power increases, the maximum intensity will exceed the MPE. Conversely, if the laser output power decreases, the laser's effectiveness will be reduced. Most eye-safe laser security devices discussed in the parent invention employ semiconductor diode lasers operating in the red wavelength portion of the light spectrum. The output power of such semiconductor diode lasers varies significantly with drive-current fluctuations, temperature, and cumulative use. It is therefore important to employ a means for controlling the output power to maximize safety and effectiveness.

The third problem in laser illuminator design for laser security devices is the size of the unit. Until recently, the relatively large size of laser-producing components have prevented the use of laser technology in personal protection or security applications. However, the development of semiconductor laser diodes operating at appropriate wavelengths and power outputs, and the availability of surface-mounted electronic integrated circuits for power control, have made hand-held laser security devices possible. The more compact these components are, the more useful they are to military and police personnel already overloaded with equipment.

The fourth problem relates to the mechanical stability of both the laser and the optical system. The position of the laser source relative to the collimating lens must be accurately maintained. The mechanical means for mounting these two components relative to each other must account for fine adjustment during assembly (for approximately accurate distancing and alignment between the laser source and the lens), and subsequently, maintain that alignment during rough use.

The fifth problem is control of the heat generated by the laser diode, the cooling subsystem and the electronic circuits. These three sources combine to produce several watts of waste heat which must be conducted away from the temperature-sensitive semiconductor laser diode. In larger laser systems, a fan could be employed for that purpose. However, in compact, hand-held laser security devices, heat sinks should be employed to provide the necessary thermal management. Moreover, the compact nature of the hand-held laser security devices must be taken into account, since the temperature rise is inversely related to heat sink volume.

The final problem is the desire to maximize the psychological and physiological impact that the laser security device imparts to the adversary. Field tests have demonstrated that a round, uniform, red laser beam (e.g., one to two feet in diameter) which is directed towards or shined upon an adversary's chest provides a strong psychological impact. If the engagement is escalated by moving the beam to the subject's eyes, the physiological response of the eye to such bright light hinders further action. Moreover, it is deemed desirable to have the laser beam quickly or repetitively flash on and off. Studies have shown that a frequency of 7 to 9 Hertz is optimal for inducing disorientation in a person.

The present invention resolves these design issues by providing a laser illuminator that integrates the optical, laser, power control, and thermal management means into a single, small, compact (or, modularized) unit. The present invention also employs a novel fiber optic means for producing a smooth, relatively flat beam intensity distribution to optimize effectiveness and eye-safety. The present invention is suitable for use in any embodiment of the eye-safe laser security devices described in the referenced patent and will enhance their effectiveness, safety, and usefulness. The present invention also provides a sealed module that is easily replaced when it fails, or upgraded to an improved design based on new technological advances.

Accordingly, it is an object of the present invention to provide a single, compact, high-powered laser illuminator module to succeed the separate optical, laser, power control, and thermal management subsystems in prior art laser security and/or illumination devices.

It is a further object of the present invention to provide a self-contained laser illuminator module having a fiber-optic means for converting the sharply peaked, highly elliptical, astigmatic output beam from a semiconductor laser diode into a relatively smooth, uniform, circular laser beam suitable for effective use in an eye-safe laser security device.

It is also an object of this invention to provide a laser illuminator module having a means to flash the laser beam on and off at a nominal rate of 8 Hertz to provide disorientation and added psychological impact to the adversary.

It is also an object of this invention to provide a laser illuminatormodule having a mechanical means for adjusting the alignment of optical components to achieve optimum output of the laser illuminator which also serves to maintain that alignment during use.

It is also an object of the present invention to provide a smaller, light-weight, portable laser illuminator module through compact integration of electronic control means required for operation.

It is also an object of the present invention to provide a laser illuminator module having a means to protect the semiconductor laser diode from damage due to overheating through a novel heat sink design and an integral, self-resetting thermal fuse.

SUMMARY OF THE INVENTION

The present invention is a laser illuminator for producing a laser beam to provide warning and/or visual impairment. The laser illuminator includes electronic control means, a fiber optic means and a means for mounting. The present invention is designed to be used in a laser security device to generate a laser beam to illuminate and/or create temporary visual impairment of a potential adversary. In the preferred mode, the present invention is powered by a power source within the laser security device to provide a visual deterrent to an adversary which results in hesitation, delay, distraction, surrender or retreat. The means for mounting provides a seal against external moisture and dust to protect internal components and is preferably dimensioned to fit within a laser security device.

DESCRIPTION OF THE PREFERRED EMBODIMENTS

Figure 3:
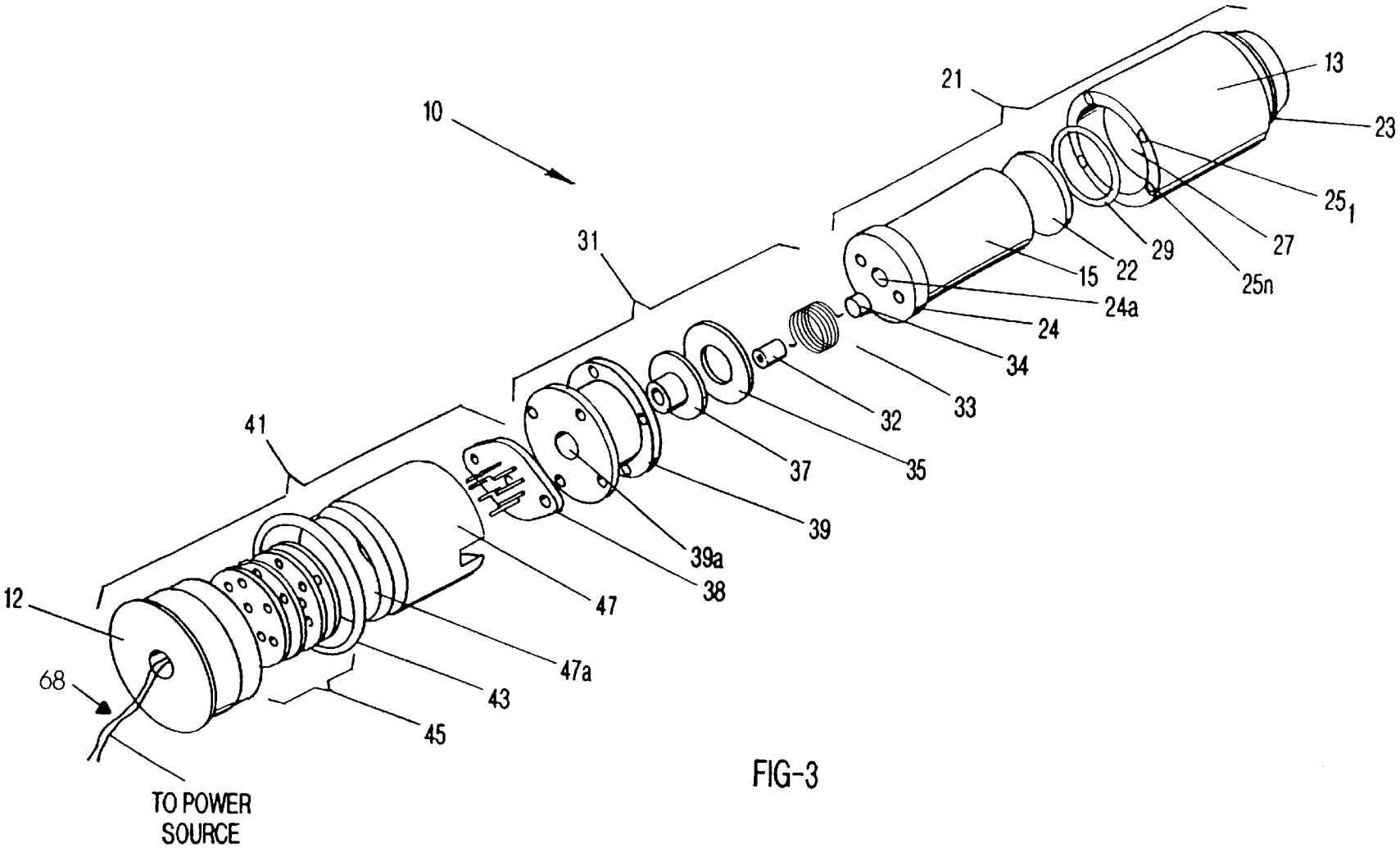
FIG. 3 is an exploded view of the laser illuminator of the present invention.
Figure 4A:
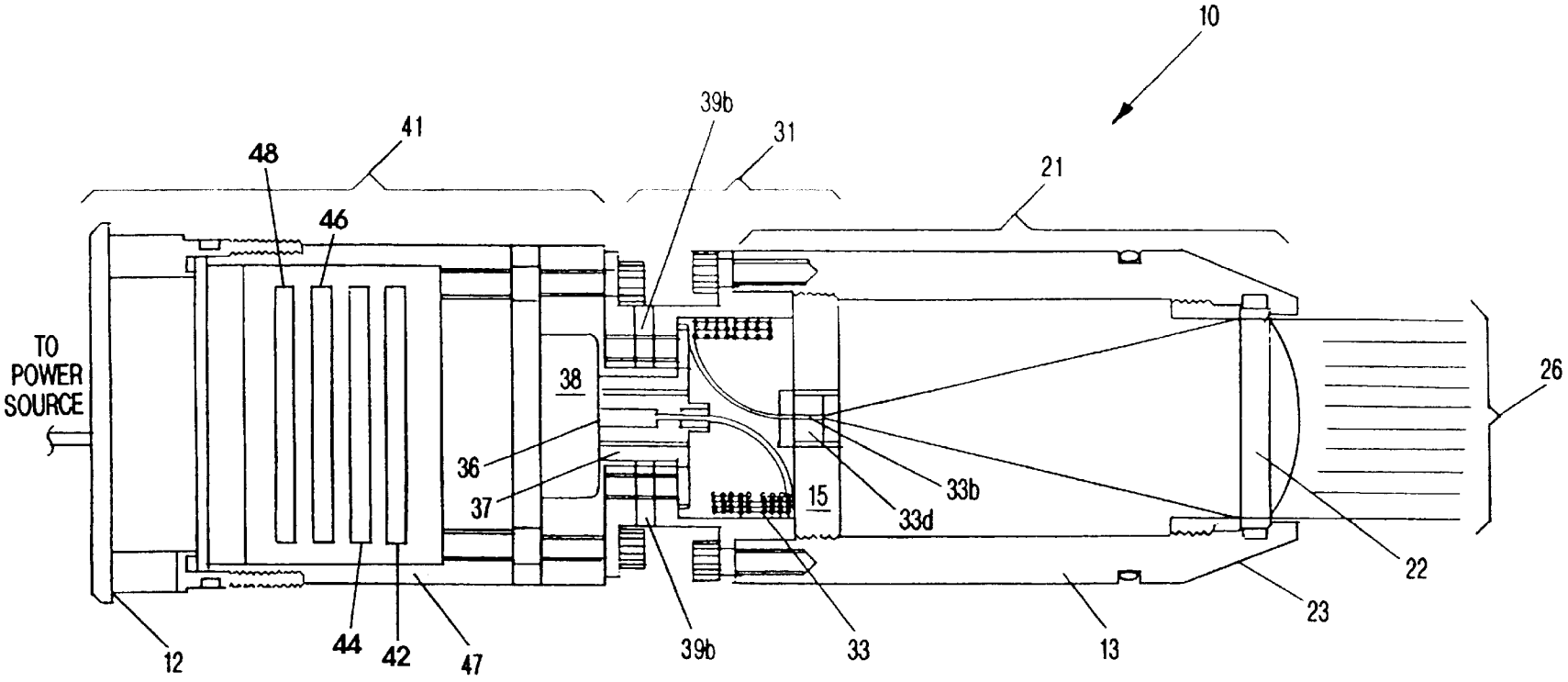
FIG. 4*a* is a cross-sectional view of the laser illuminator of the present invention depicting the relationship of various elements as assembled.

The self-contained laser illuminator 10 of the present invention is shown generally in FIGS. 3 and 4. As seen in FIG. 3, laser illuminator 10 includes means for mounting 21, fiber optic means 31 and electronic control means 41 in optical communication with fiber optic means 31.

Means for mounting 21 includes laser illuminator casing 13 and casing base 15. Preferably, laser illuminator casing 13 and casing base 15 are constructed of hard anodized aluminum for strength, durability, shock resistivity and resistance to environmental hazards. Additionally, laser illuminator casing 13 is preferably sized so as to fit within a specific laser security device's housing, such as a flashlight or a baton. Means for mounting 21 has a tapered portion 23 at one end, a plurality of threaded screw holes $\mathbf{25}_1 \ldots \mathbf{25}_n$ at the other end, and further, has an internal passageway 27 longitudinally formed therethrough. Within passageway 27 is placed O-ring 29, plano-convex collimating lens 22 and forward fiber optic mount 24, respectively. Within passageway 27, O-ring 29 sits on a lip (not shown) internally formed within laser illuminator casing 13 near its tapered portion 23. In this placement, O-ring 29 prevents plano-convex lens 22 from exiting means for mounting 21 through tapered portion 23. Forward fiber optic mount 24 is a cylindrically walled structure having at least one internal channel 24*a* formed therethrough. Casing base 15 is coupled to forward fiber optic mount 24 on a first end, and is adapted to support plano-convex lens 22 within passageway 27 at its second end. Forward fiber optic mount 24 is sized to receptively fit within internal passageway 27.

Figure 4B:
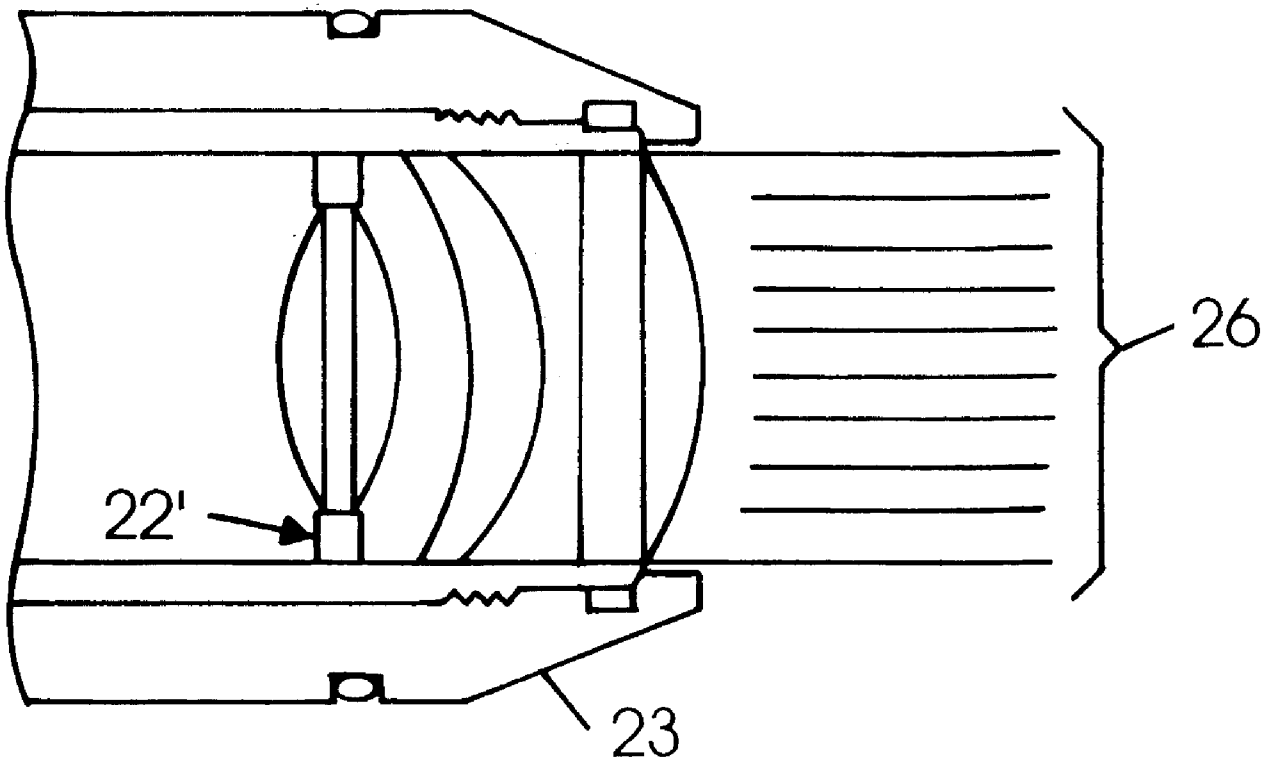
FIG. 4*b* is a cross-sectional view of a portion of the laser illuminator shown in FIG. 4*b* illustrating a multi-element lens.
Figure 9:
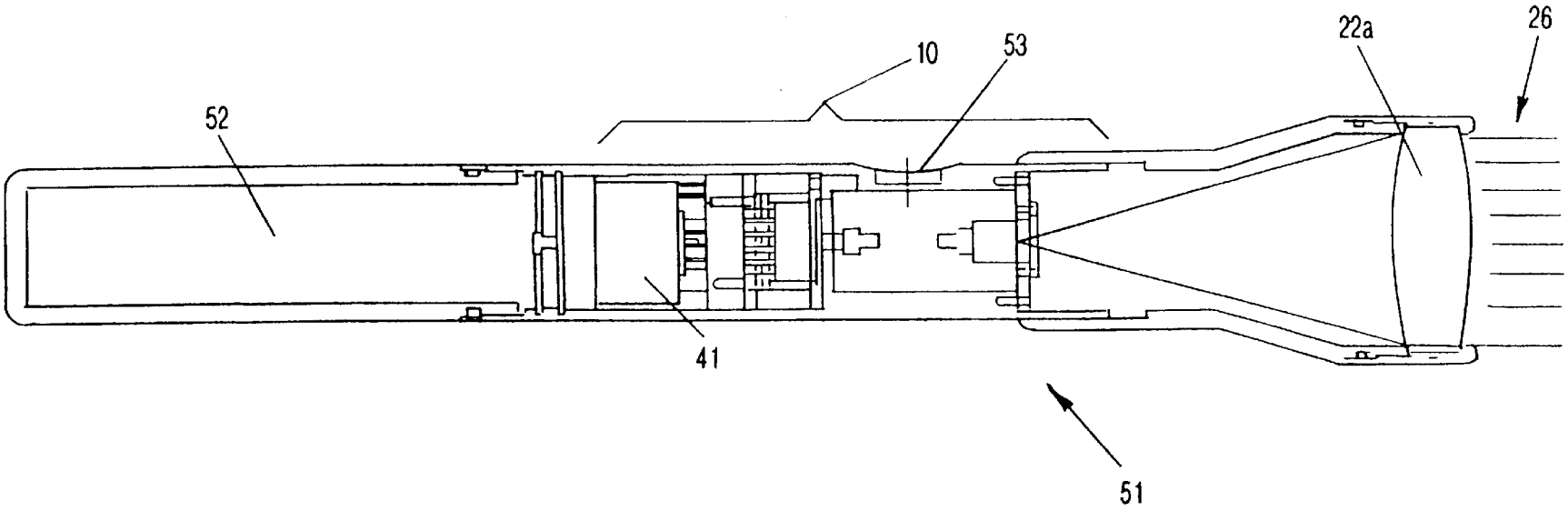
FIG. 9 shows the preferred embodiment of the present invention when employed within a laser security device.

The function of collimating lens 22 is to reduce the spread angle of emitted laser beam 26 to a desired size. Collimating convex lens 22 is preferably adapted to produce a 50 millimeter focal length laser beam 26. A plano-convex lens is a preferred collimating lens over an aspheric lens because aspheric lenses are expensive and do not provide acceptable laser beam focusing in the near field. As depicted in FIGS. 4 and 9, when the present invention is operated, a resulting laser beam 26 emerges from laser illuminator 10. Because laser beam 26 exits laser illuminator 10 with a wide divergence angle, collimating lens 22 is required to reduce the spread of laser beam 26. Collimating lens 22 is focused by adjusting its position to provide a laser beam spot diameter of approximately 50–100 centimeters at the location of an intruders, typically 100 meters away. As laser light 26 emitted from laser diode 38 is highly divergent, collimating lens 22 is required to collimate laser beam 26 so that a useful spot size (e.g. 10–50 centimeters) can be projected on the intended target. A conventional short focal length (approximately 50 millimeters), plano-convex lens is available from a number of commercial optical suppliers (including Newport Corporation in Irvine, Calif., Model Number KPX082) and is sufficient, although multi-element lenses 22' as shown in FIG. 4*b* in the drawings may be used in some applications.

Figure 5:
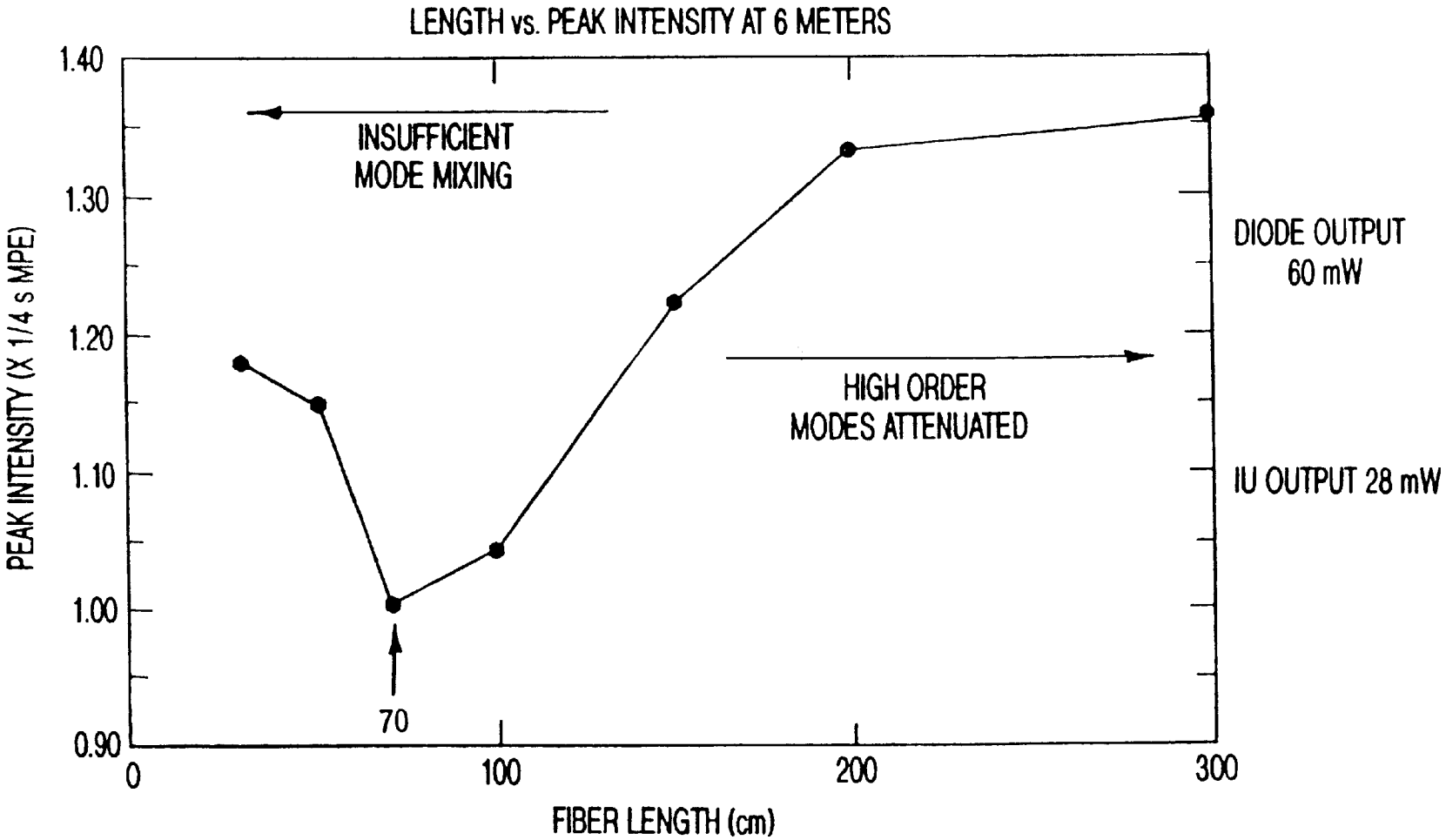
FIG. 5 is a graph illustrating optimum fiber optic cable length employed by the present invention.
Figure 5A:
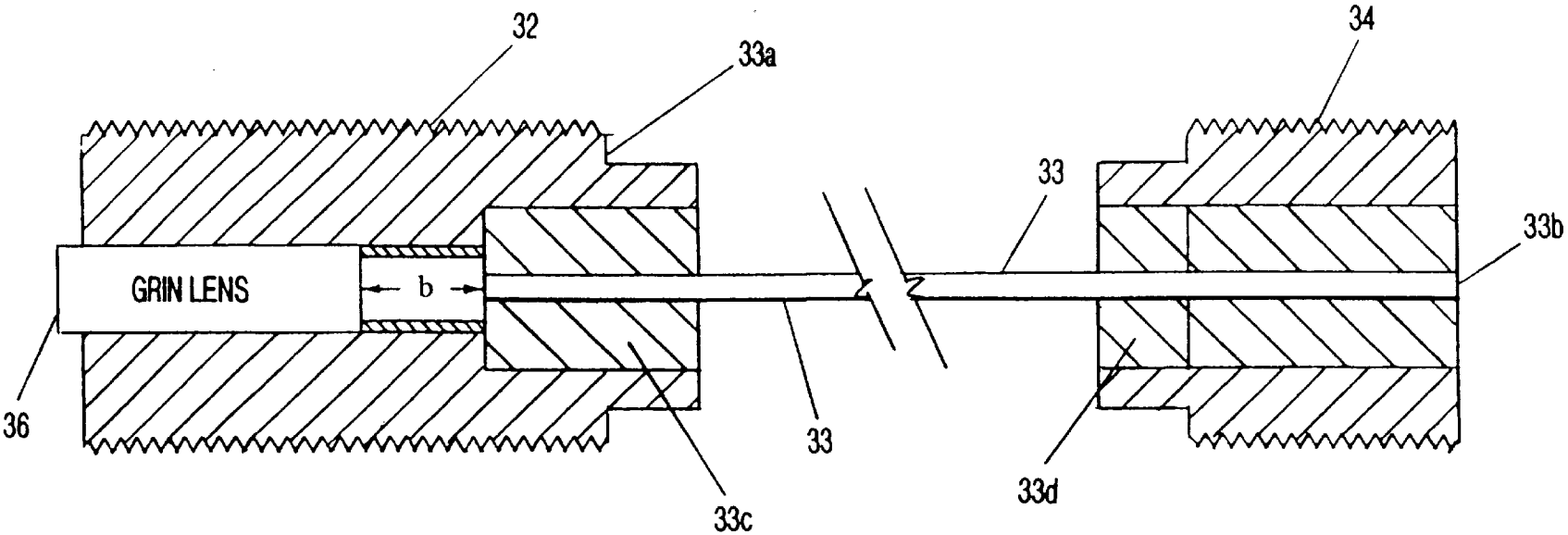
FIG. 5*a* is a detailed cross sectional view of several fiber optic cable assembly components of the present invention.

Fiber optic means 31 includes fiber optic cable 33 having a first end 33*a* and a second end 33*b* (as seen in FIG. 5*a*), a fiber optic cable retainer 35, a fiber optic rear mount (or, button) 37 and a fiber optic spool flange 39 having an internal corridor (shown generally as item 39*a* in FIG. 3) formed therein. Securely attached to fiber optic cable first end 33*a* is first ferrule connecting means 32 adapted to adjustably connect the fiber optic cable first end 33*a* to button 37. Fiber optic cable first end 33*a* is securely attached to first ferrule 32 by a modified SMA-905 connector 33*c*. In similar fashion, attached to fiber optic cable second end 33*b* is a second ferrule connecting means 34 adapted to adjustably connect the fiber optic cable second end 33*b* to the forward fiber optic mount base 24 through internally threaded aperture 24*a*. Fiber optic cable second end 33*b* is securely attached to second ferrule 34 by a modified SMA-905 connector 33*d*.

Figure 1:
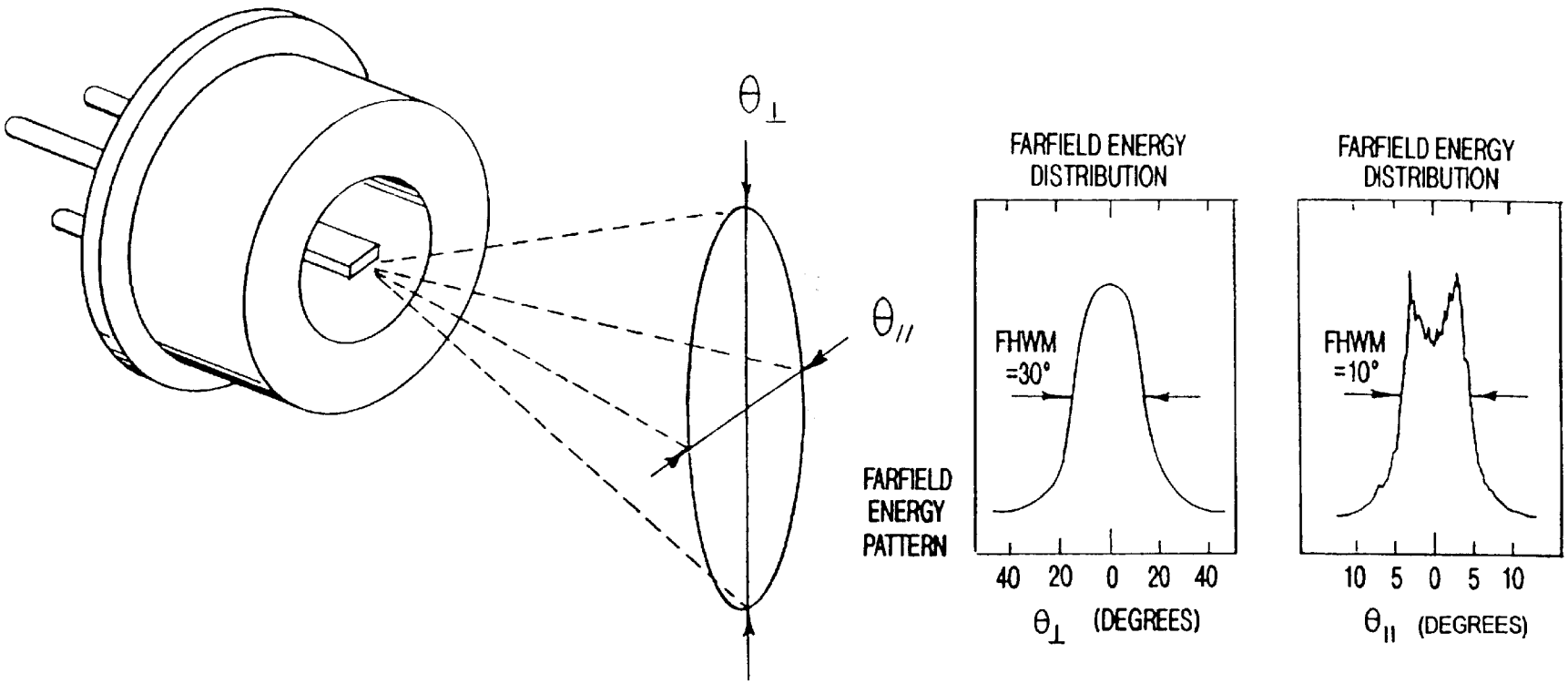
FIG. 1 is a graph illustrating the intensity profile through the two axes of a semiconductor laser output beam identifying the laser's high peak intensity and the elliptical beam shape.
Figure 2:
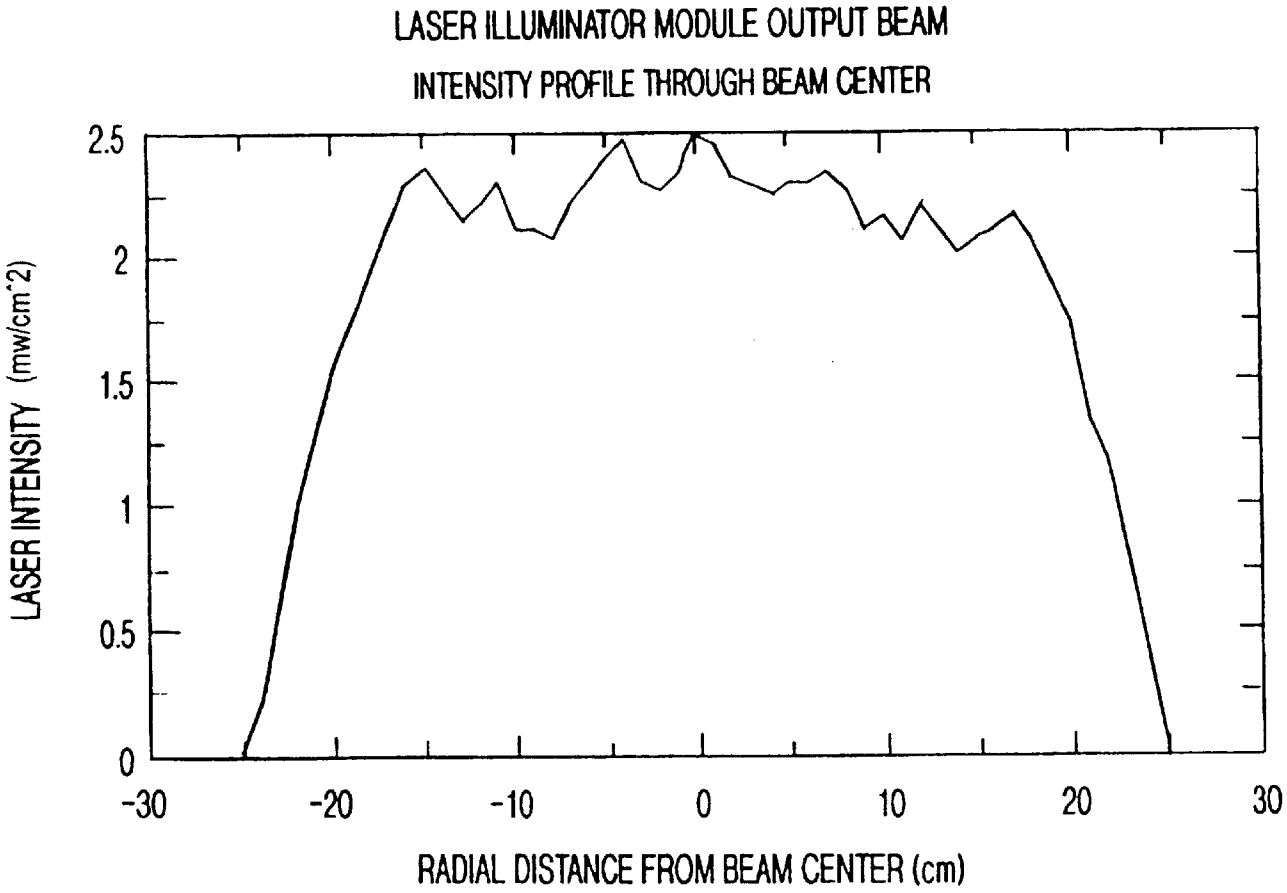
FIG. 2 is a graph illustrating the intensity profile of the laser output beam from the present invention identifying a smooth intensity profile and circular beam shape.
Figure 6:
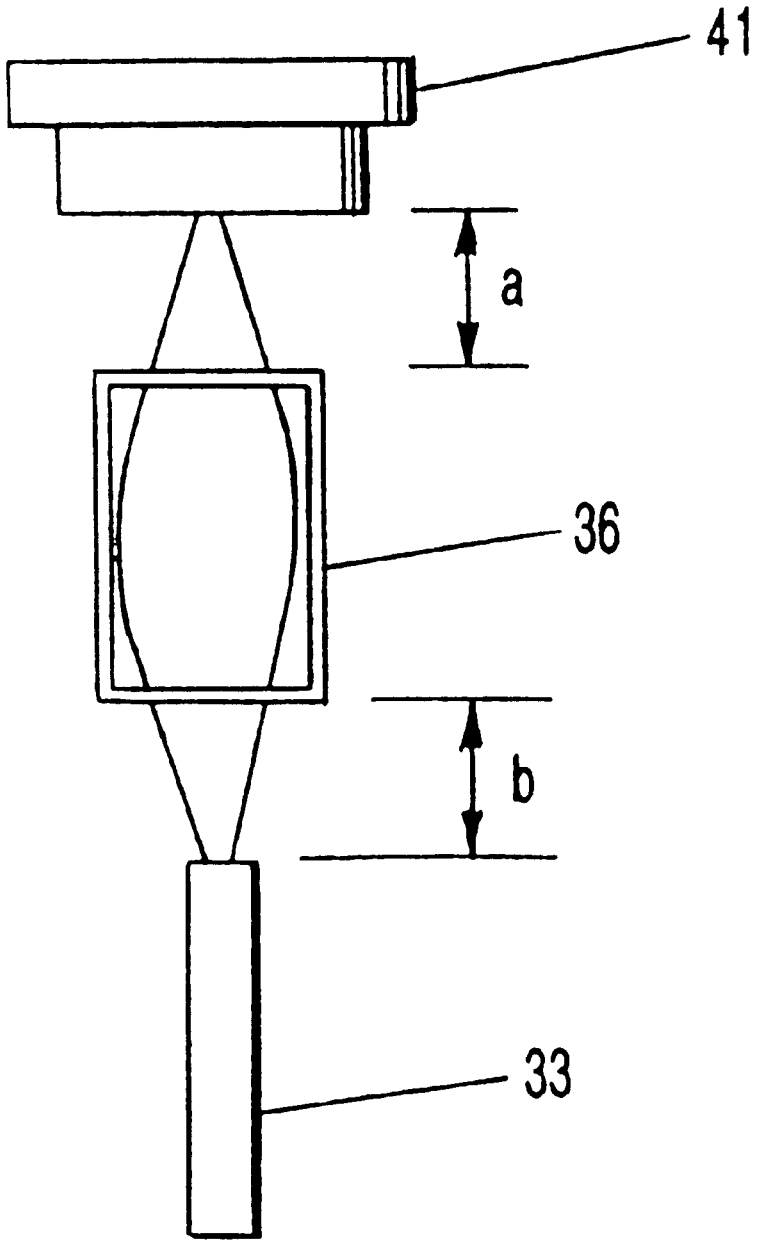
FIG. 6 depicts variable distance "a" between the laser diode and the gradient index lens, and distance "b" between the gradient index lens and one end of a fiber optic cable, all of the present invention.
Figure 7:
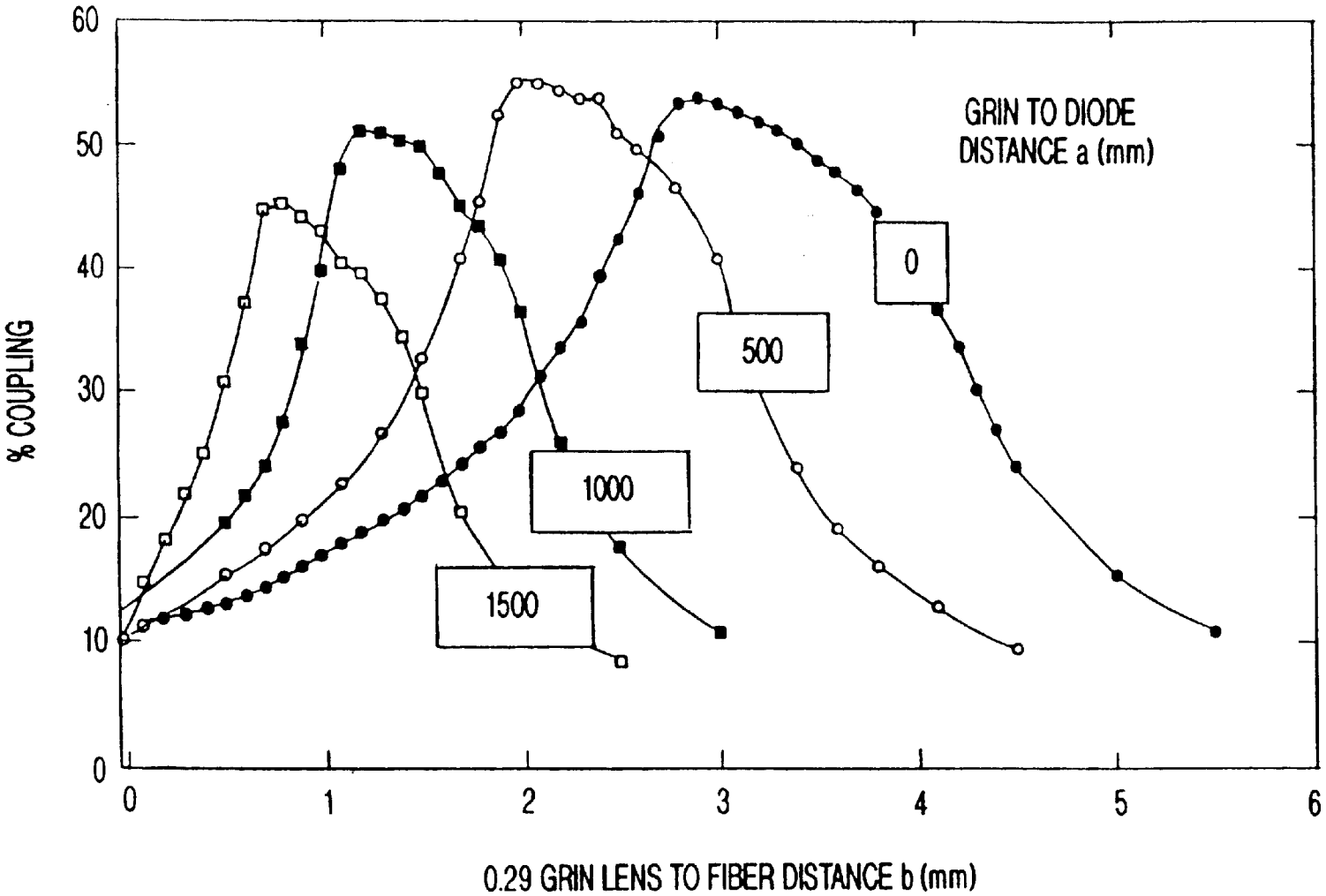
FIG. 7 is a graph illustrating the effect on the gradient index lens on the output performance at variable distances "b" as depicted in FIG. 6.

Because output laser beam 26 is initially emitted from laser diode 38, the initial laser beam is elliptical and spreads much more in one axis than the other; typically 10 degrees in the narrow axis and 40 degrees in the wide axis (as illustrated in FIG. 1). Therefore, a gradient index lens is necessary to compensate for this phenomenon. At fiber optic cable first end 33*a* and within first ferrule connecting means 32 is coupled gradient index lens 36 (shown generally in FIG. 4). An example of a preferred gradient index lens is Model Number SLW-180-029-063 manufactured by NSG America, Inc. In the preferred mode, any resulting laser beam 26 emitted from laser illuminator 10 must be optimized depending on several considerations, including the power output of laser diode 38, the type of gradient lens 36 used, the distance from the laser beam output from gradient lens 36 to fiber optic cable first end 32 and the proper alignment of fiber optic cable 33 within forward fiber optic mount 24. As seen in FIG. 6, manufacturing of the present invention results in a potentially variable first distance between laser diode 38 and gradient index lens 36 (identified as distance "a") and a fixed second distance between gradient lens 36 and fiber optic cable's first end 33*a* (identified as distance "b"). To accommodate manufacturing tolerances, distances a and b are dependant upon one another in optimizing the characteristics of any emitted laser beam 26. As such, in the preferred embodiment seeking to generate a resulting laser beam 35 centimeters in diameter at 50 meters, a 2.2 millimeter distance a between the gradient lens and the fiber optic cable's first end 32 is deemed quite acceptable. Employing approximately a 2.2 millimeter distance allows for manufacturing tolerance adjustment to optimize performance characteristics. To obtain the desired distance a, fiber optic rear mount 37 includes an internally threaded aperture adapted to receive first ferrule 32 which is externally threaded. In order to obtain the proper distance a between gradient index lens 36 and laser diode 38, first ferrule 32 is screwed into fiber optic rear mount 37. Fiber optic rear mount 37 is then attached to fiber optic spool flange 39 loosely by conventional attachment means (e.g., screws) for proper adjustment of gradient index lens 36 in the x, y and z coordinate directions. To adjust gradient index lens 36 so that it aligns with the output of laser diode 38, a plurality of adjustment boreholes 39*b* are formed in the fiber optic spool flange 39. Screws are then inserted into boreholes 39*b* to adjust gradient lens 36 in the x and y directions. Adjustment in the z direction is executed by screwing (or unscrewing) first ferrule 32 into (or out of) fiber rear mount 37. Once the desired positioning of gradient index lens 36 is achieved, fiber rear mount 37 is then securely attached to fiber optic spool flange 39.

Preferably, fiber optic cable 33 is a hard clad 200 micron core fiber having a numerical aperture equivalent to approximately 0.48 and 70 centimeters in length. As seen in FIG. 5, a 70 centimeter length is deemed sufficient to provide optimized mode mixing, which results in uniform laser beam output. Because of its extended length and because of the limited space available in fiber optic spool flange 39, it is convenient to wind fiber optic cable 33 within fiber optic spool flange corridor 39*a*. When corridor 39*a* retains fiber optic cable 33, it is useful to employ fiber cable retainer 35 to assist in retaining the fiber cable as it is being inserted into corridor 39*a*.

Electronic control means 41 includes laser diode 38, O-ring 43 and means for electronically controlling 45, all enclosed within cylindrical shell 47. Shell 47 further has an internal vestibule 47*a* longitudinally formed therethrough, and at one end is securely attached to flanged external housing base 12. In some applications of the present invention, the natural environment leads to extremely high temperatures. In such environments, the thermoelectric cooler efficiency is poor, and because of the size of the present invention, there is a limited amount of heat sink capable of drawing heat away from the electronics. Therefore, due to the amount of heat potentially generated by the electronic circuits in electronic control means 41, shell 47 is preferably constructed of copper material, which acts as an efficient heat sink to thereby dissipate heat, and, after installation of the electronic circuit boards 45, is filled with a heat-conducting, high specific heat epoxy material (such as available from Tra-Con, Inc., Bedford, Mass., Stock Number BC-2151).

Laser diode 38 is the primary component of electronic control means 41. Preferably, laser diode 38 is a single component having the laser diode, a photodiode (to sense the optical power from the laser), a thermoelectric cooler and a high resist thermistor (to sense the laser diode temperature) all in the same diode package. Preferably, laser diode 38 is a continuous-wave semiconductor diode laser that emits visible laser light at wavelengths from 630 nanometers to 660 nanometers at power ranges of 25 to 250 milliwatts. Laser diode 38 is also adapted not to exceed the MPE limits for laser safety for up to a quarter second of constant laser emission at ranges exceeding six meters. Laser diode 38 is capable of projecting a laser beam diameter of 35±5 centimeters at 50 meter range, the resulting laser beam being collinear with the axis of laser illuminator 10 to within half of the beam diameter at 50 meter range. Commercial laser diode units available which meet these requirements include Model SDL-7422-H1 (manufactured by Spectra Diode Labs, Inc. in San Jose, Calif.) and the 650-200-T3 (manufactured by Applied Optronics Corp. in South Plainsfield, N.J.). Although shorter laser wavelengths (e.g. orange, yellow, or green colors) would be more effective at producing glare and flashblind, semiconductor diode lasers capable of producing these wavelengths at 0.015 to 2.0 watts of power are not yet commercially available. Limited power versions (less that 5 milliwatts of light output) of such lasers have been produced in the laboratory, and should be commercially available in higher powers within 5 years. As those skilled in the art will appreciate, future advances in this laser technology will improve the effectiveness of all embodiments of this invention are within the spirit and the scope of the present invention.

As a alternate embodiment to employing a semiconductor diode laser, a continuous-wave frequency-doubled neodymium-YAG laser could be used. These commercially available lasers (such as those from Santa Fe Laser Corp., Model C-140-D), employ an infrared semiconductor diode laser to energize a neodymium-YAG rod thus producing laser light in the green portion of the wavelength spectrum (532 nanometers), which is optimum for producing the flashblind and glare effects. Those skilled in the art will appreciate that wavelengths ranging from approximately 400 nanometers to 700 nanometers (approximately the visible portion of the wavelength spectrum) can be employed to induce the effects of glare or flashblind. While this particular laser diode component does not currently exist in the dimensions required in the present invention, those skilled in the art will appreciate that it (and similar laser diodes) may be miniaturized in the future and still be within the spirit and scope of the present invention.

As seen in FIG. 4, electronic control means 41 includes four separate electronic subassemblies: laser socket assembly 42; thermoelectric cooler supply assembly 44; laser diode supply assembly 46; and timing circuit 48. Each subassembly is a separate circuit board, the orientation of which is trivial so long as each subassembly is in electrical communication with each other and with fiber optic means 31. In turn, electronic control means 41 is connected to a power source by power bus 68 which is also in electrical communication with an on/off switch of the laser security device in which the laser illuminator is mounted.

Figures 1, 8:
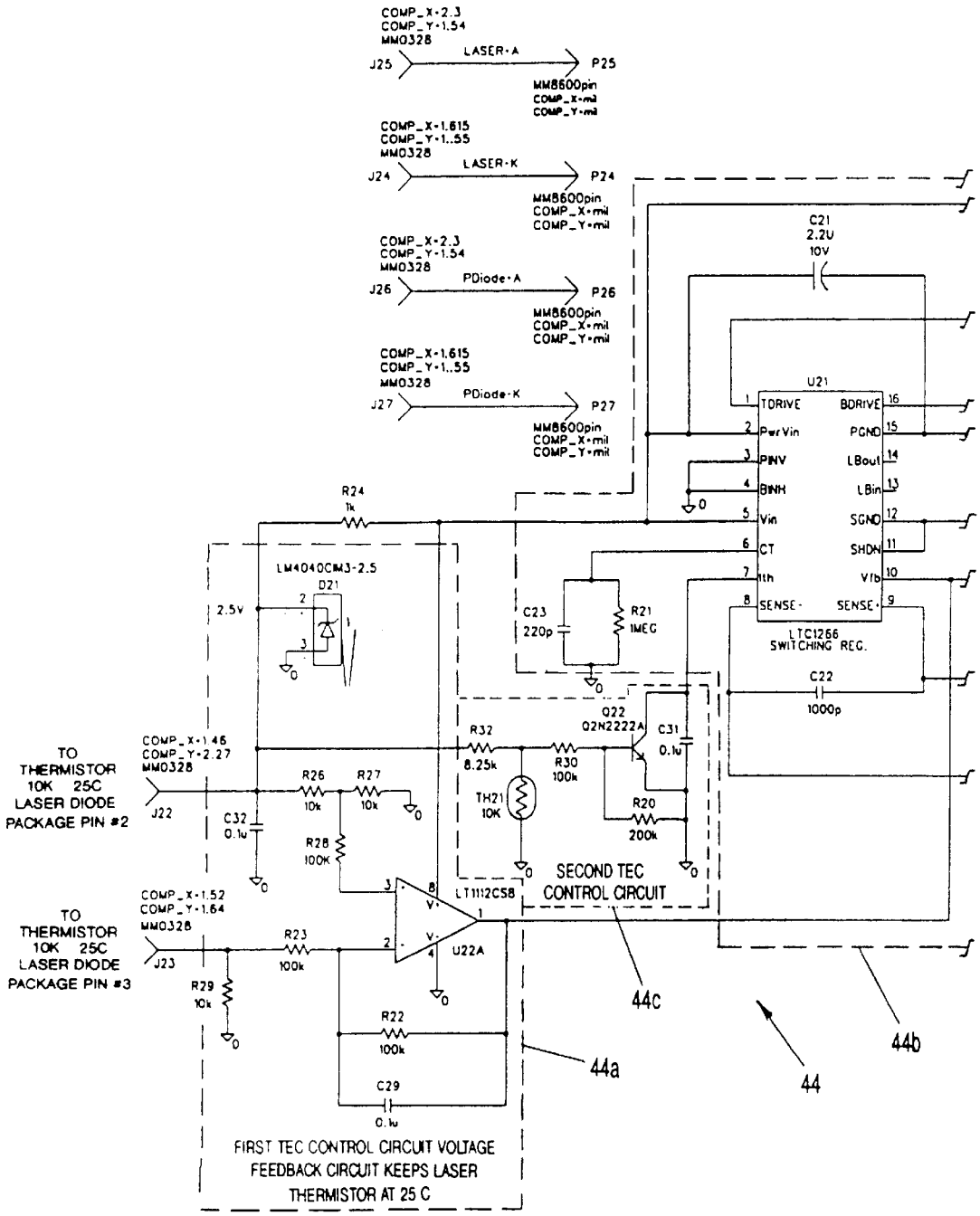
FIG. 8 illustrates the thermoelectric cooler power supply circuit of the present invention.
Figures 2, 8:
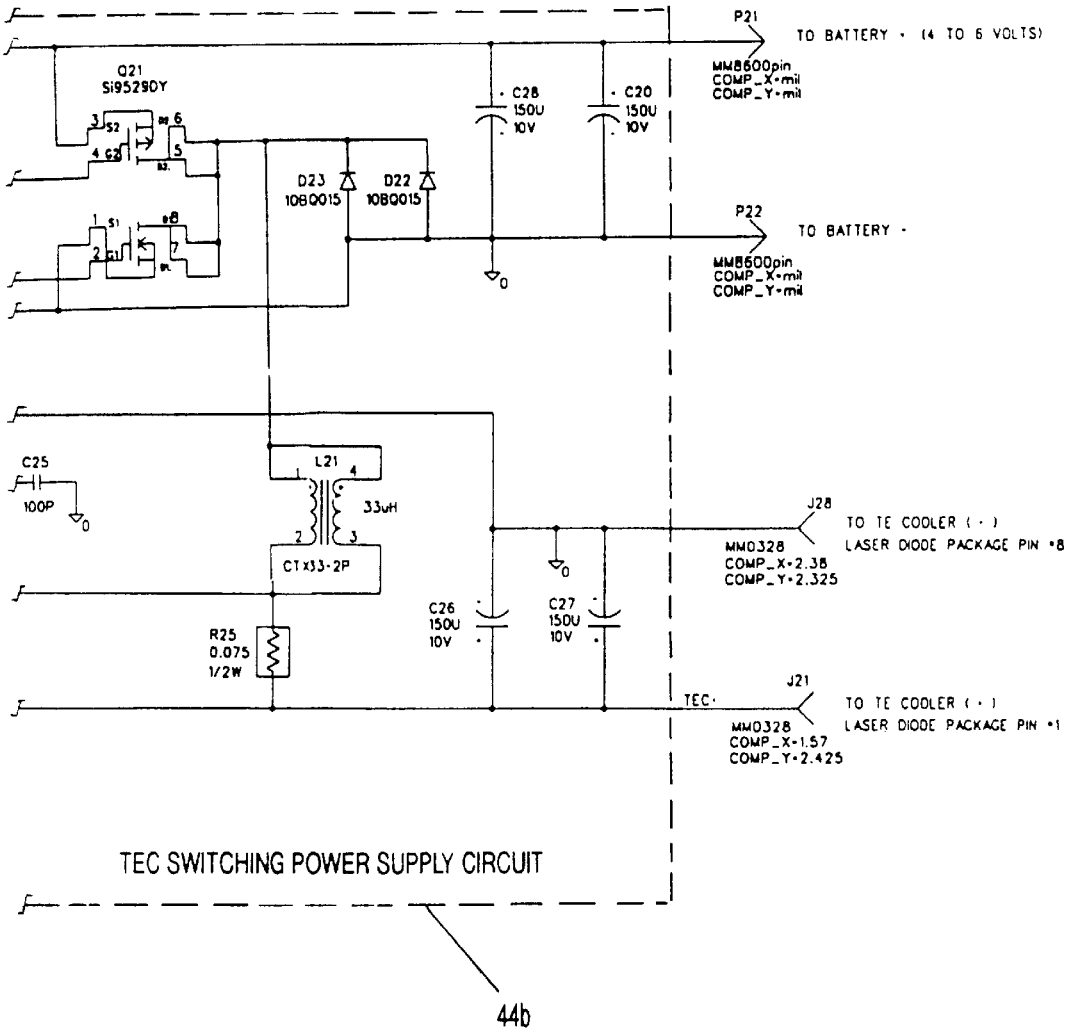
Figures 1, 8A:
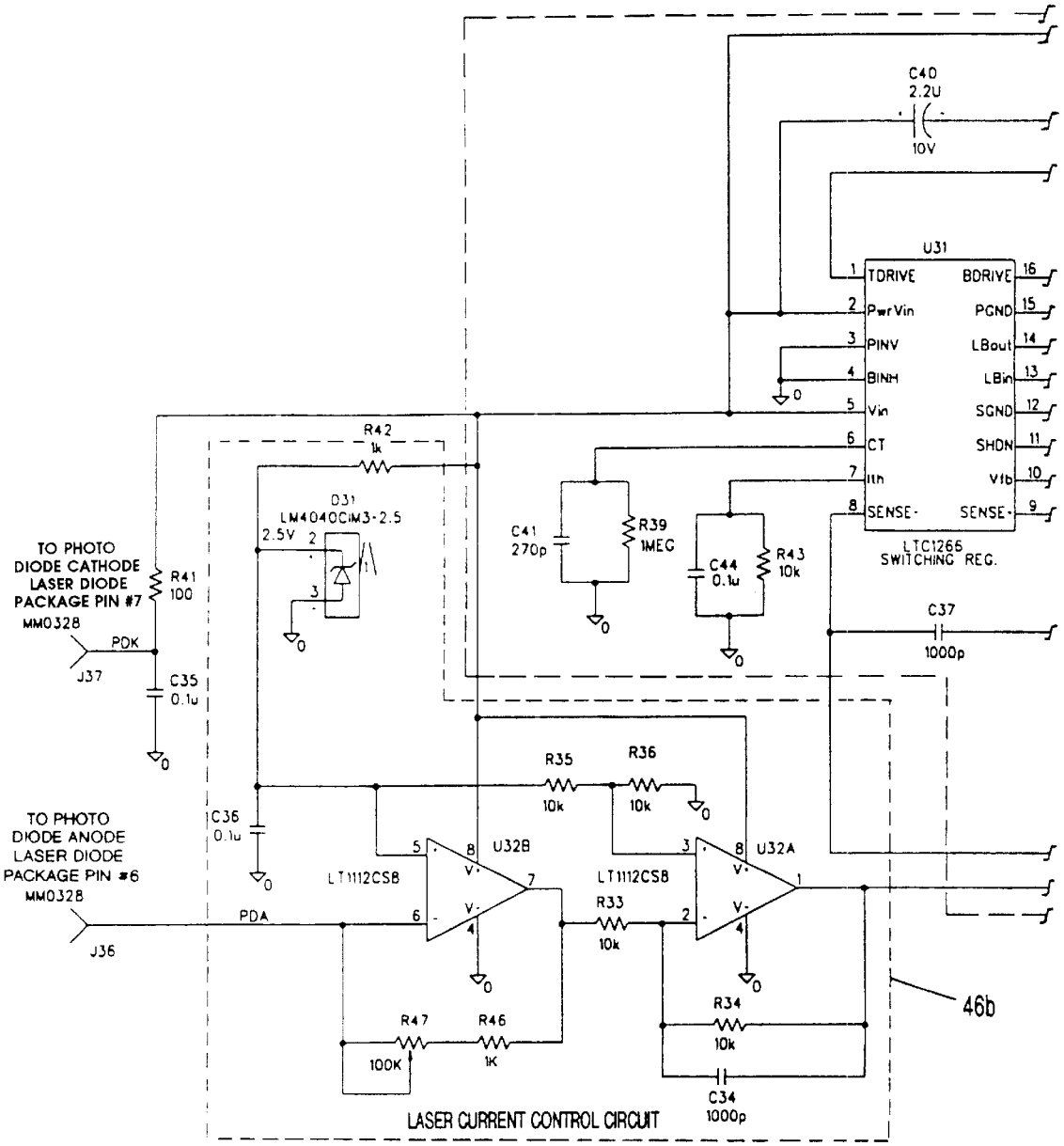
FIG. 8*a* illustrates the means for controlling a laser diode's power of the present invention.
Figures 2, 8A:
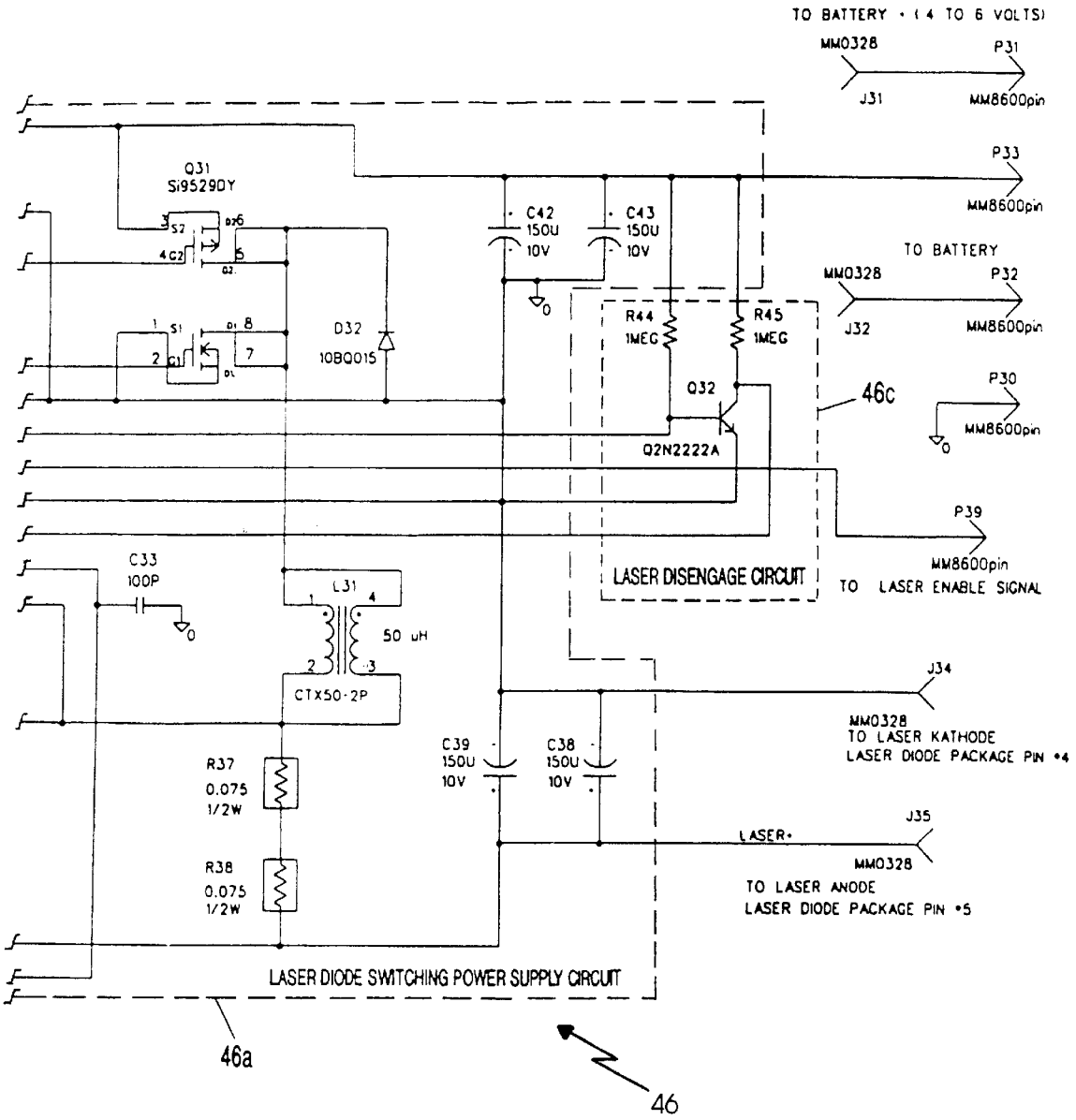
Figures 1, 8B:
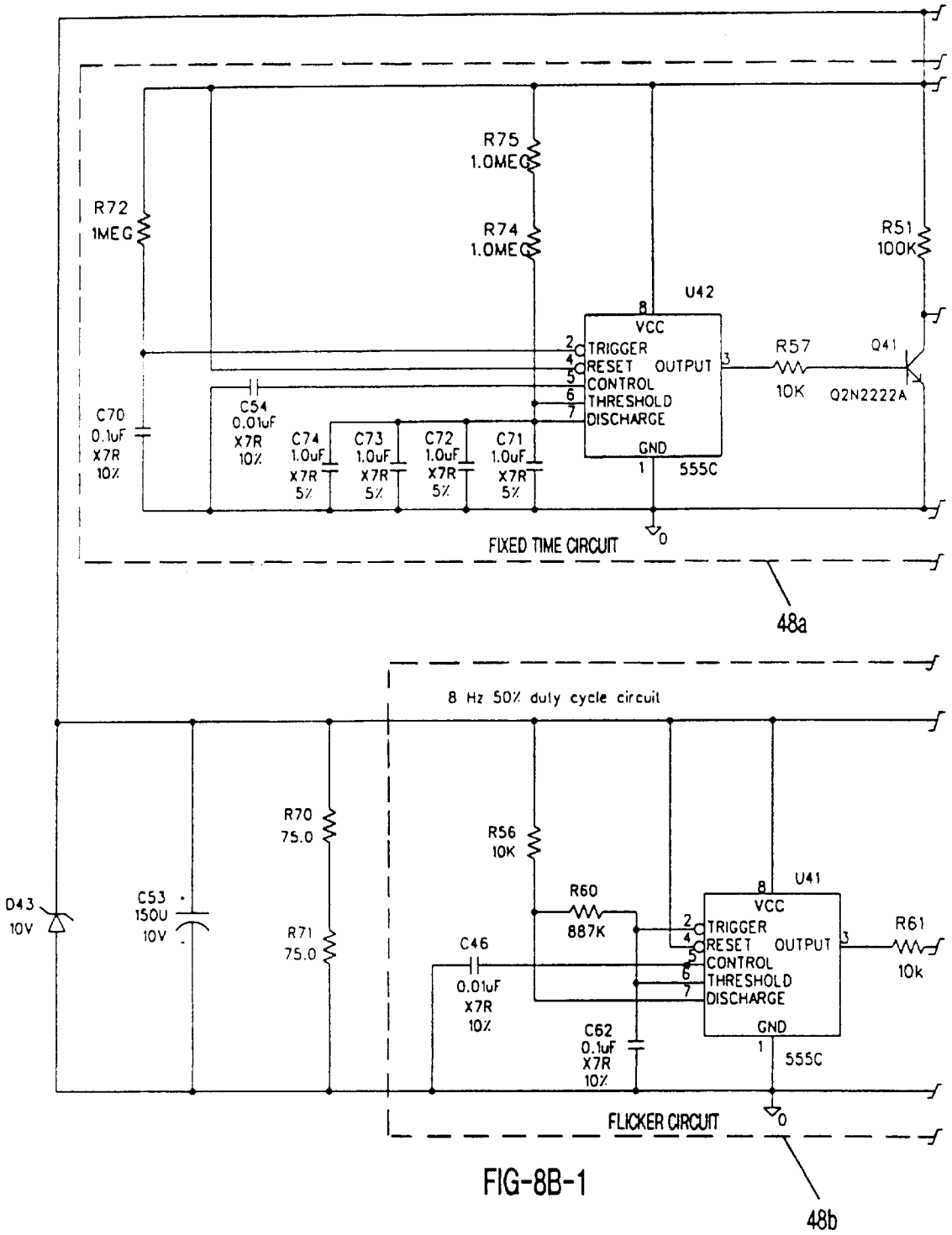
FIG. 8*b* illustrates the means for electrically timing of the present invention that provides flashing at a rate of 8 Hertz after 10 seconds of continuous operation.
Figures 2, 8B:
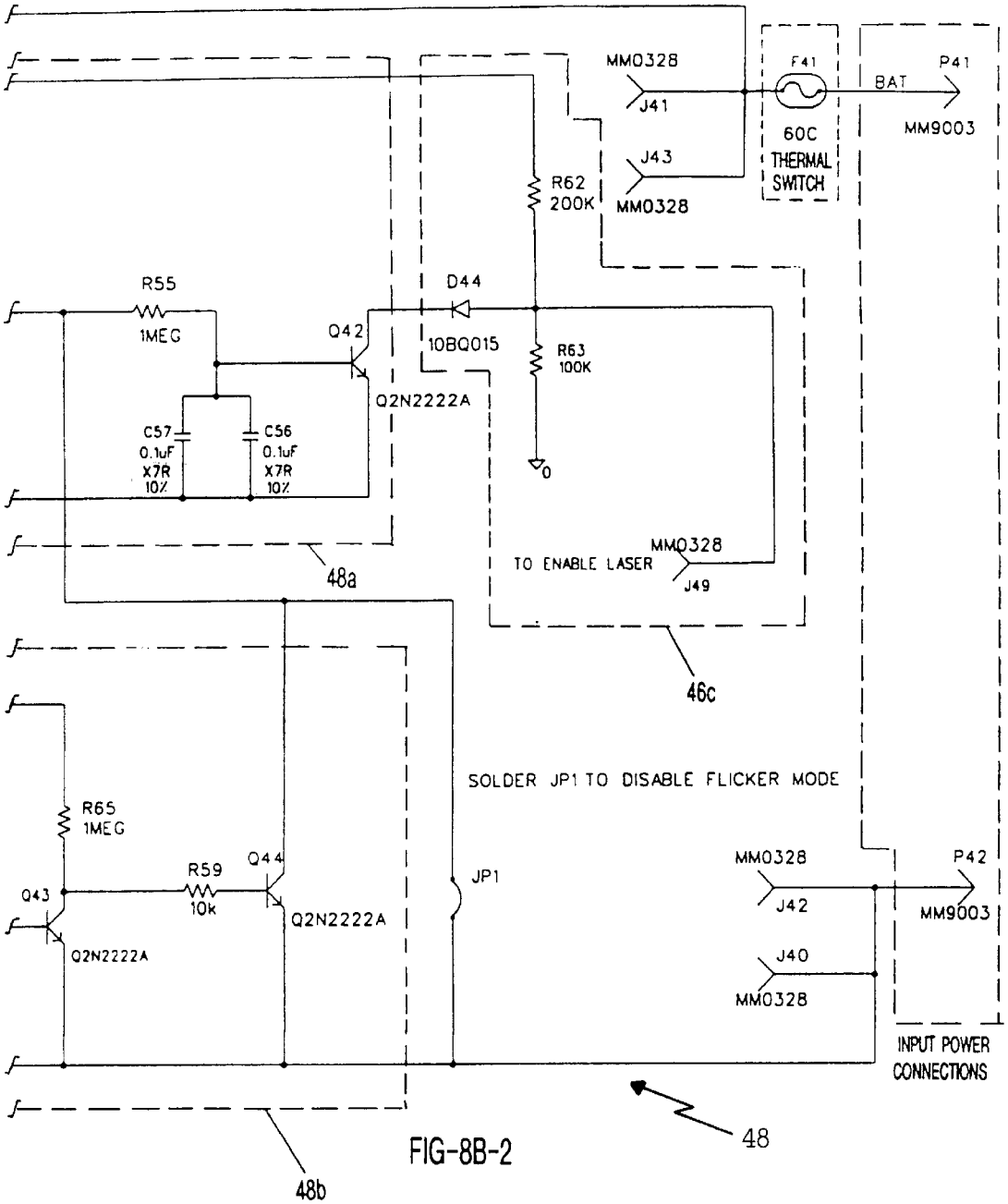
Figure 8C:
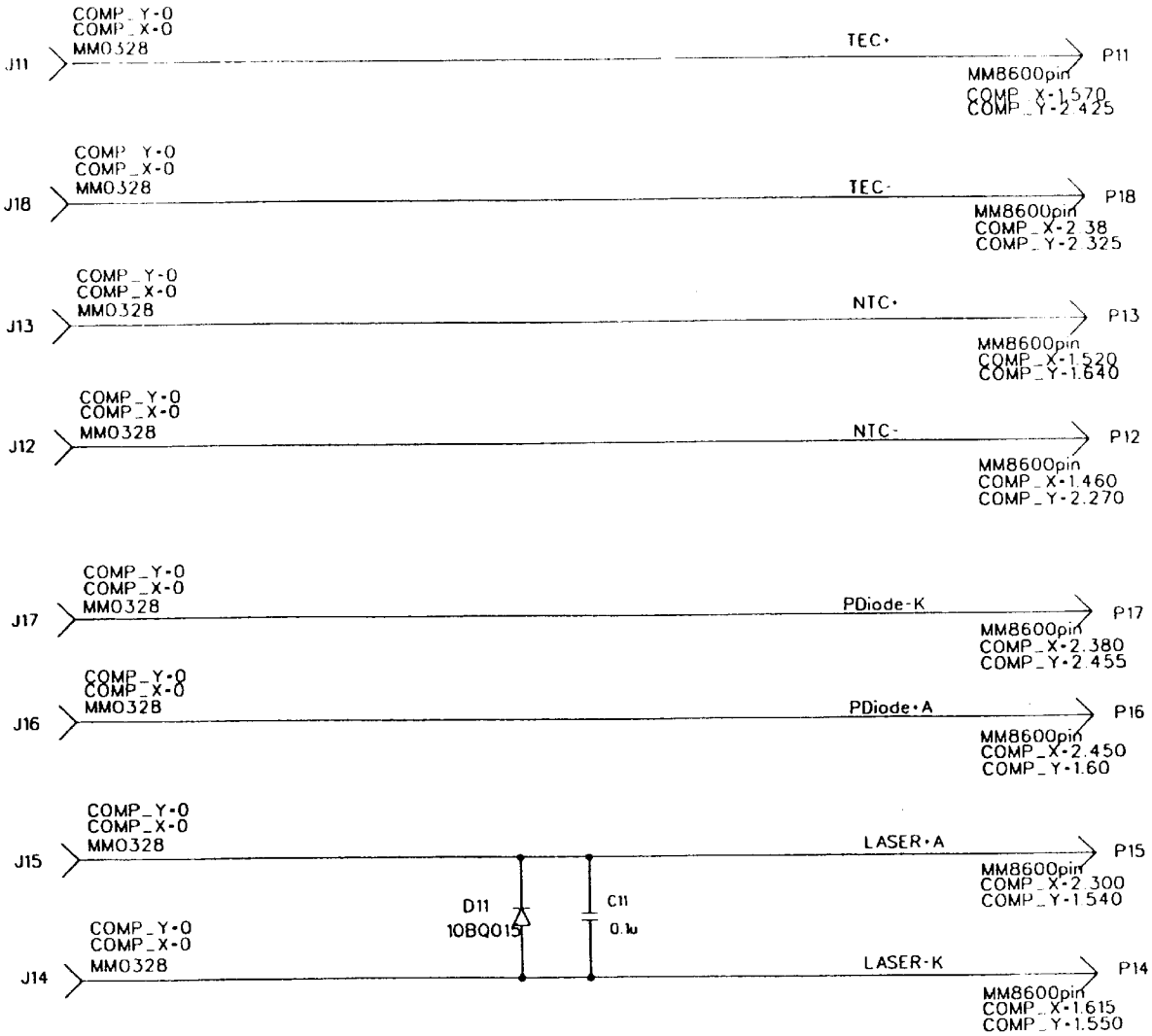
FIG. 8*c* illustrates the laser socket board circuit diagram which serves as an interface between the laser diode and the remaining three circuit boards.

As seen in FIG. 8*c*, the first electronic assembly is laser socket assembly 42, which includes capacitor C11 to limit high frequency voltage across laser diode 38 and Schotky diode D11 to protect laser diode 38 from reverse bias voltages.

As seen in FIG. 8, the second electronic assembly is thermoelectric cooler supply assembly 44, which supplies power to the thermoelectric cooler (built into the laser diode package) and which maintains the temperature of laser diode 38 and a laser thermistor (built into the laser diode package) at low temperatures. Thermoelectric cooler supply assembly 44 also contains voltage feedback electronics 44*a* to control the electrical output current of the switching power supply 44*b*: in particular, the voltage feedback electronics 44*a* is adapted to monitor the thermistor's (located with the laser diode package) resistance. If the resistance on the thermistor decreases, then the voltage feedback electronics 44*a* drops below 1.25 volts and thereby controls switching power supply 44*b* to increase output current. Conversely, if voltage feedback electronics 44*a* increases beyond 1.25 volts (representing higher thermistor resistance), voltage feedback electronics 44*a* controls switching power supply 44*b* to decrease output current. Moreover, thermoelectric cooler control circuit 44*c* is designed to reduce the current to the switching power supply 44*b* when heatsink thermistor TH21 senses temperatures of less than 30° C.

The third electronic assembly is laser diode supply assembly 46 as seen in FIG. 8*a*, which includes laser diode power supply circuit 46*a* to supply power to laser diode 38, laser current control circuit 46*b* and laser disengage circuit 46*c*. Laser current control circuit 46*b* controls the electrical output current of the laser diode power supply circuit 46*a*: in particular, the laser current control circuit 46*b* is adapted to monitor the laser diode's 38 photodiode current (the photodiode current is directly proportional to laser diode output power). If the photodiode's current decreases, then laser current control circuit 46*b* drops below 1.25 volts and thereby controls laser diode power supply circuit 46*a* to increase output current. Conversely, if photodiode's current increases, laser current control circuit 46*b* controls laser diode power supply circuit 46*a* to decrease output current. The purpose of laser diode supply assembly 46 is to maintain a constant power output from laser diode 38.

Laser disengage circuit 46*c* (as seen in FIGS. 8*a* and 8*b*) is designed to turn off the laser power supply when the input voltage to laser diode supply assembly 46 drops below 3.75 volts nominal. The 3.75 volts threshold level is purely a design choice adapted to correct any fluctuation in the laser current control circuit and is not a means of limitation.

The fourth electronic assembly is timing circuit 48 (as seen in FIG. 8*b*). Timing circuit 48 includes a fixed time circuit 48*a*, a flicker circuit 48*b*, a thermal switch F41 and power input connections P41 and P42. Fixed time circuit 48*a*, in the preferred embodiment, is a ten second one shot circuit. When power is applied to the laser diode 38, fixed time circuit 48*a* allows continuous power to be applied for ten seconds. If laser diode 38 is engaged for more than ten seconds, flicker circuit 48*b* engages to turn power laser diode 38 on and off repetitively at a rate of 8 Hz until power to laser diode 38 is disengaged. Thermal switch F41 is preferably set so that if the heatsink and electronics temperature of the laser illuminator 10 rises above 60° C., it disengages all power in the electronic assemblies to thereby protect laser diode 38 from high temperature operation. In the preferred embodiment, time circuit's 48*a* circuit board is also formed with a plurality of access holes to allow access to the laser assembly potentiometer for adjusting the laser optical power after all electronic assemblies are interconnected.

As those of skill in the art will also come to realize, electronic control means 41 can also be encapsulated with epoxy (or similar electrically insulative, thermally conductive material) to prevent tampering with any electronic component and to provide additional heat sink mass. Moreover, electronic control means 41 is preferably adapted to operate in extended temperature ranges, be powered from rechargeable battery sources, be capable of controlling power consumption for extended operation of the present invention, automatically turn off at extended high temperature ranges, be resistant to shock or vibration and be resistant to environmental hazards such as moisture. Because of the internal space available in laser illuminator 10 (for example, approximately 1.36 inches), the electronic control means 41 is also designed to take up as small a space as possible in all axial directions. Thus, the electronic circuitry, in the preferred embodiment, is designed to be stacked, electrically interconnected circuit boards having surface mount electrical components on both sides of each circuit board. While four separate electronic assemblies in the electronic control means 41 are disclosed, those of ordinary skill will realize that similar electronics can be implemented in similar designs, even at miniature scale, and therefore, the preferred mode is disclosed as an example and not as a means of limiting the scope of the present invention. Moreover, although sub-miniature electronic component technologies, such as surface-mount technology, are disclosed, the preferred embodiment is based on commercially available components and are not a means of limitation.

FIG. 9 illustrates the present invention when employed within flashlight laser security device 51. In this embodiment, flashlight 51 is an elongated housing structure adapted to internally receive laser illuminator 10. Flashlight 51 further includes on/off switch 53 which is in electrical communication with both power source 52 and power bus 68 of electronic control means 41. Lens 22, shown in the preferred embodiment of FIGS. 3 and 4, has been replaced by a larger lens 22*a* appropriate to the flashlight laser design.

When the flashlight laser security device 51 utilizing the present invention is in operation, an operator of the flashlight first observes one or more suspected intruders or potential adversaries. The operator aims the flashlight at the body (e.g., torso) of one of the intruders and energizes laser beam 26 for a few seconds as a warning. The intruders will see a large (approximately 50 centimeter diameter) laser beam 26 illuminating them. If the intruders attempt to move, the operator can follow them with the visible laser beam by panning the flashlight laser as necessary to follow the assailant. At this point, it would be obvious to the intruders that they have been detected and, because the laser beam moves with them, that they are under observation. All but the most intent intruders will either turn and run, or surrender. An important issue in physical security applications is early assessment of the intruders' intent so that the security forces can adjust their response accordingly. The intruders' response to this initial warning will help with this assessment process. If the intruders do not retreat or surrender after seeing the unequivocal warning, it is a likely indication that they are serious intruders who are willing to risk being physically harmed to accomplish their goal.

If the intruders continue towards their goal, the operator engages flashlight 51 (and thus, engages laser illuminator module 10) by depressing laser activation switch 53 again and aims it at the intruder's eyes. The flashblind and glare effects produced by laser beam 26 make it more difficult for the intruders to move quickly or to see any arriving security forces. When looking back towards laser beam 26 during daylight, it is very difficult to see things in the direction of laser illuminator 10; at night, it is almost impossible to see anything when looking in the general direction of laser illuminator 10. If the intruders are armed and choose to engage the security forces in a gun battle, the flashblind and/or glare from laser illuminator 10 will greatly reduce their ability to hit specific targets coming from the direction of laser illuminator 10. Naturally, the present invention can be incorporated into various housings such as a police baton, motion detector or vehicle lighting system, all with the result of providing warning through illumination and/or visual impairment.

Whereas the drawings and accompanying description have shown and described the preferred embodiment of the present invention, it should be apparent to those skilled in the art that various changes may be made in the form of the invention without affecting the scope thereof.

We claim:

1. A self-contained laser illuminator module comprising:

a. an electronic control means for producing a laser beam, the electronic control means including a laser;

b. fiber optic means for producing a relatively smooth, uniform, substantially circular laser beam having relatively flat beam intensity distribution, the fiber optic means being in optical communication with the electronic control means and including a fiber optic cable; and c. means for mounting within the laser illuminator module a collimating lens for adjustable movement with respect to the laser;

wherein the self-contained laser illuminator module is capable of being effectively used in an eye safe laser security device.

2. The self-contained laser illuminator module as defined in claim 1 wherein the laser comprises a laser diode.

3. The self-contained laser illuminator module as defined in claim 1 wherein the fiber optic cable is wound in a loop.

4. The self-contained laser illuminator module as defined in claim 3 wherein the fiber optic means further comprises a gradient index lens interposed between the laser and an end of the fiber optic cable.

5. The self-contained laser illuminator module as defined in claim 2 wherein the fiber optic cable is wound in a loop.

6. The self-contained laser illuminator module as defined in claim 5 wherein the fiber optic means further comprises a gradient index lens interposed between the laser diode and an end of the fiber optic cable.

7. The self-contained laser illuminator module as defined in claim 6 wherein the gradient index lens is located a predetermined distance from the laser diode.

8. The laser illuminator module of claim 1 wherein the laser comprises a laser diode, a photodiode, a thermoelectric cooler and a high-resist thermistor, all in electrical communication with each other.

9. The laser illuminator module of claim 1 wherein the collimating lens is a plano-convex lens.

10. The laser illuminator module of claim 1 wherein the collimating lens is an aspheric lens.

11. The laser illuminator module of claim 1 wherein the laser is adapted to repetitively flash on and off at a frequency of approximately 7 to 9 Hertz.

12. The laser illuminator module of claim 2 wherein the laser diode is a continuous-wave semiconductor diode that emits laser light at power ranges of 25 to 250 milliwatts.

13. The laser illuminator module of claim 1 wherein the laser is a continuous-wave frequency-doubled neodymium-YAG laser at power ranges of 25 to 250 milliwatts.

14. The laser illuminator module of claim 1 wherein the means for mounting further includes a casing having an internal passageway longitudinally formed therethrough and a base located at one end of the casing, an O-ring disposed on a lip formed within the casing adjacent to the collimating lens and a forward fiber optic mount coupled to the base.

15. The laser illuminator module of claim 14 wherein the casing and the base are formed of hard anodized aluminum.

16. The laser illuminator module of claim 14 wherein the forward fiber optic mount is a cylindrical structure having at least one channel formed therethrough and sized to receptively fit within the casing's internal passageway.

17. The laser illuminator module of claim 16 wherein the fiber optic means further comprises a fiber optic cable retainer disposed adjacent to the fiber optic cable, a fiber optic rear mount adjacent to the fiber optic cable retainer, a fiber optic spool flange adapted to receive and couple with the fiber optic rear mount in adjustable relation therewith, and a gradient index lens optically aligned to one end of the fiber optic cable.

18. The laser illuminator module of claim 17 wherein the fiber optic cable comprises a first end and a second end, the first end coupled to an externally threaded first ferrule connecting means which is adapted to adjustably connect the first end to the fiber optic rear mount, the first end being optically coupled to the gradient index lens via the first ferrule connecting means, and the second end coupled to an externally threaded second ferrule connecting means which is adapted to adjustably connect the second end to the forward fiber optic mount.

19. The laser illuminator module of claim 18 wherein the fiber optic rear mount further includes an internally threaded aperture adapted to receive the first ferrule connecting means.

20. The laser illuminator module of claim 17 wherein the fiber optic spool flange comprises at least one adjustment means for adjusting the gradient index lens in a predetermined coordinate axis.

21. The laser illuminator module of claim 3 wherein the fiber optic cable is a 200 micron core fiber cable having a numerical aperture of approximately 0.48 and a length of approximately 70 centimeters.

22. The laser illuminator module of claim 1 wherein the electronic control means further includes an base attached to a shell having an internal vestibule formed therethrough, an O-ring, means for electronically controlling the laser and a power bus in electrical communication with the means for electronically controlling the laser, all disposed within the vestibule.

23. The laser illuminator module of claim 22 wherein the shell is constructed of copper-based material to dissipate heat.

24. The laser illuminator module of claim 22 wherein the means for electronically controlling the laser comprises a laser socket assembly, a thermoelectric cooler supply assembly, a laser diode supply assembly and a timing circuit, all in electrical communication.

25. A device to reduce or temporarily impair the visual ability of a human by either glare or flashblinding without long-term visual impairment, said device comprising:

a. an outer housing;

b. a self-contained laser illuminator module positioned within the housing, the illuminator module comprising electronic control means for producing a laser beam including a laser, fiber optic means for producing a relatively smooth, uniform, substantially circular laser beam having a relatively flat beam intensity distribution, the fiber optic means being in optical communication with the electronic control means and including a fiber optic cable, and a means for mounting therein a collimating lens for adjustable movement with respect to the laser, the electronic control means and the fiber optic means being in optical communication and being securely disposed within the housing;

c. a switch disposed upon the housing; and d. a power source disposed within the housing, the power source being in electrical communication with the switch and the electronic control means to engage the device.

26. The device of claim 25 wherein the outer housing is a flashlight housing.

27. The device of claim 25 wherein the outer housing is a baton housing.

28. The device of claim 25 wherein the outer housing is a security system housing.

29. A method of employing a laser illuminator module within a laser security device in adversarial conditions, the method comprising the steps of:

a. providing a laser security device having a laser illuminator module therein, the laser illuminator module including a laser adapted to emit a laser beam at wavelengths from 630 nanometers to 660 nanometers at power ranges of 25 to 250 milliwatts;

b. initially observing one or more suspected intruders or potential adversaries;

c. aiming the security device at the intruder;

d. engaging the security device by energizing the laser beam to produce a large diameter illuminating laser beam;

e. continually monitoring the intruder by panning the laser beam at the intruder as the intruder moves;

f. further energizing the laser security device by aiming the laser beam at the intruder's eyes should the intruder continue to advance; and g. inducing upon the intruder a flashblind or glare effect so as to make it difficult to view in the direction of the security device.

30. A method of employing a laser illuminator module within a laser security device in adversarial conditions, the method comprising the steps of:

a. providing a laser security device having a laser illuminator module therein;

b. producing a relatively smooth, uniform, substantially circular laser beam having a relatively flat beam intensity distribution;

c. initially observing one or more suspected intruders or potential adversaries;

d. aiming the security device at the intruder;

e. engaging the security device by energizing the laser beam to produce a large diameter illuminating laser beam;

f. continually monitoring the intruder by panning the laser beam at the intruder as the intruder moves;

g. further energizing the laser security device by aiming the laser beam at the intruder's eyes should the intruder continue to advance; and h. inducing upon the intruder a flashblind or glare effect so as to make it difficult to view in the direction of the security device.

31. The method as defined in claim 30 further comprising a step of providing a laser capable of emitting laser light at wavelengths from 400 nanometers to 700 nanometers at power ranges of 25 to 250 milliwatts.

32. The laser illuminator module of claim 1 wherein the collimating lens is a multi-element lens.

* * * * *